US006896263B2

(12) United States Patent
Matthews

(10) Patent No.: US 6,896,263 B2
(45) Date of Patent: May 24, 2005

(54) GAME FOR TEACHING FUNDAMENTAL DATING LESSONS

(75) Inventor: Michael Matthews, 3228 Belle River Dr., Hacienda Heights, CA (US) 91745

(73) Assignee: Michael Matthews, Hacienda Heights, CA (US)

( * ) Notice: Subject to any disclaimer, the term of this patent is extended or adjusted under 35 U.S.C. 154(b) by 0 days.

(21) Appl. No.: 10/445,141

(22) Filed: May 23, 2003

(65) Prior Publication Data

US 2004/0232613 A1 Nov. 25, 2004

(51) Int. Cl.[7] ..... A63F 3/00
(52) U.S. Cl. ..... 273/249; 273/243
(58) Field of Search ..... 273/249, 243; 434/128, 129

(56) References Cited

U.S. PATENT DOCUMENTS 6,685,187 B1 * 2/2004 Kline et al. ..... 273/243

* cited by examiner

*Primary Examiner*—Vishu K. Mendiratta

(57) ABSTRACT

Disclosed is a game for teaching dating skills that includes a first deck containing a plurality of cards, the cards in the first deck having a face containing information representing a character trait which may be valuable when dating, and a second deck containing a plurality of card, the cards in the second deck having a face containing information representing a dating challenge and information representing at least one resolution to the dating challenge. The decks of cards are used in combination with a playing surface displaying at least one track, containing spaces corresponding to both decks of cards.

20 Claims, 2 Drawing Sheets

GAME FOR TEACHING FUNDAMENTAL DATING LESSONS

BACKGROUND OF THE INVENTION

1. Field of the Invention

This invention relates to games and, in particular, to games that are both entertaining and educational.

2. Preliminary Discussion

It is well known that most teenagers and young adults have difficulty dating and, eventually, picking a compatible spouse. Many individuals deem the attainment of a happy marriage with a compatible spouse an impossible goal to achieve and they do not even seriously consider the possibility. They consider themselves fortunate if they can settle on a mate after many years of dating, based upon some sort of societal advice. Often, unfortunately, such advice turns out to be insufficiently grounded, such that couples find their direction, quality of life, and happiness is defined by bad advice and the mistakes made during the dating stage.

Nonetheless, a few individuals are able, over time and with the application of certain principles, to pick compatible spouses which leads to happy marriages and are thus able to eliminate or greatly reduce the necessity for divorce. They are also able to realize their individual dreams of the sort that require a happy home. Correspondingly, they also achieve the sort of long term security that results from dating with a purpose.

The difference between those individuals and others who are able, over time, to weed out incompatible people and select individuals for a rewarding relationship and those who do not is that the former somehow understand the dynamics of ethics, dating with a purpose, and honesty. This understanding may be more or less self-taught or intuitive and the degree of success of a given individual usually depends upon just how well the dynamics of self esteem, wisdom, good counseling, and a purpose for dating are really understood.

These principles of self esteem, wisdom, and purpose for dating, can be taught although they are certainly not taught in most formal institutions of learning and are, to some extent, inconsistent with the date-for-fun attitude practiced by the majority of individuals. These principles are sometimes taught through parent lectures, religious organizations or more or less well written books. Some individuals, however, do not like to listen to lectures, do not get involved with religious organizations, or have the money, time, or ability, to learn the principles from a book.

Thus, it will be readily apparent that it would be highly desirable to provide a means by which the principles of dating, ethics, wisdom, and dating with purpose can be taught in a highly compressed time frame and in a manner that makes learning both fun and interactive.

SUMMARY OF THE INVENTION

Now in accordance with the invention there has been found a novel game for teaching dating skills. The game includes a deck containing a plurality of cards, where the cards in the deck have faces containing information representing a character trait which may be valuable while dating. In some embodiments this deck additionally contains cards having a face containing information indicating that the card is a bonus card.

The game also includes a deck containing a plurality of card, where the cards in the second deck have a face containing information representing a dating challenge. These cards also include information representing at least one resolution, preferably alternate resolutions, to the dating challenge.

The decks are used in combination with a playing surface displaying at least one track containing spaces corresponding to the two decks of cards. Some embodiments also include a pseudo-random number generator, player pieces, and a game board bearing the playing surface.

In some embodiments, the playing surface displays two tracks and the relative proportion of spaces corresponding to the first deck of cards to second deck of cards in the first track is greater than the relative proportion of spaces corresponding to the first deck of cards to second deck of cards in the second track. For example, in some embodiments, the relative proportion of spaces corresponding to the first deck of cards to second deck of cards in the first track is about 1:1 and the relative proportion of spaces corresponding to the first deck of cards to second deck of cards in the second track is about 1:2. And in some embodiments, the first and second tracks have a space in common.

In some embodiments, at least one track further comprises a space with a designation that a player landing on the space must take an action concerning the player's dating status. In some embodiments, at least one track further comprises a space with a designation that a player landing on the space must choose between taking an action concerning the player's dating status, picking a card from the first deck or picking a card from the second deck. And in some embodiments, at least one track further comprises a space with a designation that a player other than a player landing on the space must choose whether the player landing on the space must take an action concerning the player landing on the space's dating status, pick a card from the first deck or picking a card from the second deck.

DETAILED DESCRIPTION OF THE PREFERRED EMBODIMENTS

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

The object of the inventive game is to teach the players fundamental dating lessons relating to when to date, when not to date, and the ramifications following from choices made by the players. In some embodiments, game play moves from dating-for-fun on to serious dating and the winner is the first player whose experiences during serious dating result in marriage.

Referring now to the Figures, FIGS. 1–4 show various components of one embodiment of a game in accordance with the invention and additional features of playing the game. In the preferred embodiment illustrated by these Figures, the game is constructed as a board game.

Figure 1:
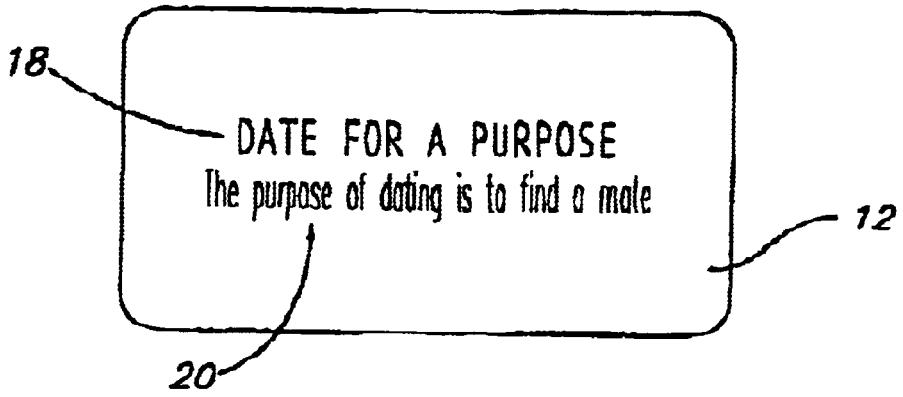
FIG. 1 is a plan view of an information surface of a card from a first deck of cards for use in accordance with present invention.
Figure 2:
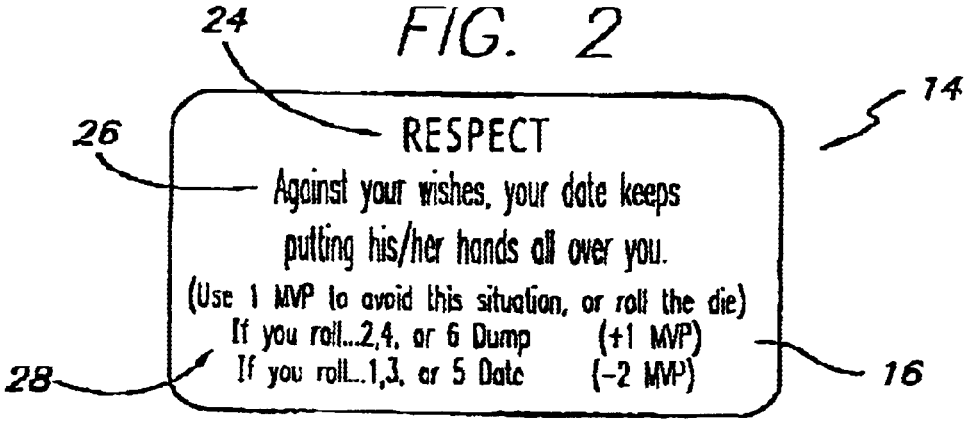
FIG. 2 is a plan view of an alternative information surface of a card from a first deck of cards for use in accordance with present invention.

The materials that constitute the board game include two decks of printed cards. As seen in FIG. 1, one deck contains a plurality of cards 10 (one shown). Each card from the first deck has an information face 12 representing character traits which may be valuable when dating. As seen in FIG. 2, the other deck contains a plurality of cards 14 (one shown). Each card from the second deck has an information face 16 representing challenges which may present themselves during dating. One of the objects of the game is earn the valuable character trait cards. In contrast, the challenges generally have negative consequences. Therefore, one of the strategies underlying the game is to avoid challenges by choosing not to date, by redeeming character cards that have been accumulated or by chance.

The character cards 10 all suitably include a back face with a common design 17. (FIG. 4) The content on the information face 12 of the character cards relates to such character traits as morals, values, and principles. Each information face can include a caption 18 describing the character trait represented by the card, followed by a description 20 of how the character trait relates to dating situations. For example, as shown in FIG. 1, the information face 10 of a character card could contain the caption "Date for a Purpose" followed by the description, "The purpose of dating is to find a mate." Representative character card content is presented in Table 1.

TABLE 1

| | |
|---|---|
| Peer Pressure | Move on if your date is needy or selfish. |
| Peer Pressure | You shouldn't date because you're being pressured. |
| Date for a Purpose | The purpose of dating is to find a mate. |
| Independence | Don't date if you are not financially stable. |
| Greed | You don't date for money. |
| Focus | Move on when there is no future. |
| Focus | You shouldn't date if you want to remain single. |
| Date for a Purpose | You don't date just for fun. |
| Peer Pressure | Move on if you are ready to commit, but your date won't. |
| Focus | Watch how your date handles stressful situations. |
| Focus | Don't date if you can't be honest and open. |
| Peer Pressure | Before dating, find things that you enjoy doing. |
| Compatible | Move on when there is constant drug use. |
| Date with a Purpose | Don't date a person who would not make a good parent. |

Figure 3:
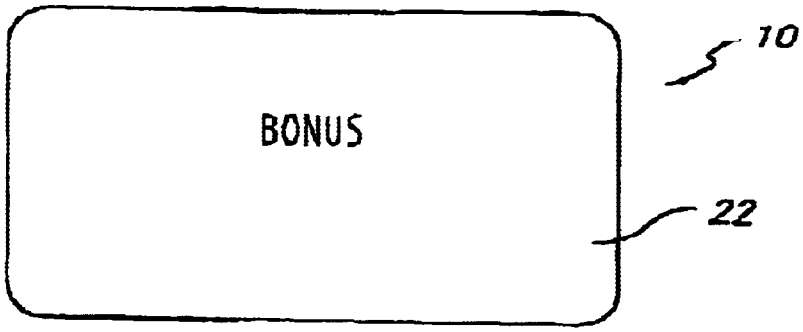
FIG. 3 is a plan view of an information surface of a card from a second deck of cards for use in accordance with present invention.

As shown in FIG. 3, an additional element of chance can be interjected in the game by having the information face 22 of selected character cards 10 indicate that the cards are bonus cards. A player drawing such a card can exchange the bonus card for two (or more) additional character cards.

The challenge cards 14 suitably include a back face with a common design 23. (FIG. 4) The content on the information face 16 of the challenge cards relates to situations commonly encountered during dating. Each information face can include a caption 24 describing the character trait that might be applied when confronted with a certain situation, followed by a description of the situation 26. For example, as shown in FIG. 2, the information face 16 of a challenge card could contain the caption, "Respect," followed by the description, "Against your wishes, your date keeps putting his/her hands all over you."

Each challenge card 14 also contains alternative, resolutions 28 to the dating situation. For example, the challenge card may provide that a player faced with the challenge can avoid the challenge by redeeming one or more character cards or the challenge card may provide that the resolution can be determined by chance, such as by the roll of a die. Resolutions determined by chance may also involve the awarding or the taking away of challenge cards. Representative character card content is presented in Table 2.

TABLE 2

| | |
|---|---|
| Self Control | |
| You were kissing and touching which led you to go a lot further than you planned. You got "caught up" and did not use protection. | |
| (Loose 2 MVPs and roll the die) | |
| If you roll . . . 1, or 3 Pregnant | (−2 MVPs) |
| If you roll . . . 1, or 5 STD | (−2 MVP) |
| If you roll . . . 2, 4, or 6 Great Time | (0 MVP) |
| Compatible | |
| Your date treats you well, but always treats others poorly. | |
| (Use 1 MVP to avoid this situation, or roll the die) | |
| If you roll . . . 2, 4 or 6 Dump | (+1 MVP) |
| If you roll . . . 1, 3 or 5 Date | (−2 MVP) |
| Respect | |
| You both agree to make commitments but, then continue to see other people. | |
| (Use 1 MVP to avoid this situation, or roll the die) | |
| If you roll . . . 2, 4 or 6 Dump | (+1 MVP) |
| If you roll . . . 1, 3 or 5 Date | (−2 MVP) |
| Respect | |
| Against your wishes, your date keeps putting his/her hands all over you. | |
| (Use 1 MVP to avoid this situation, or roll the die) | |
| If you roll . . . 2, 4 or 6 Dump | (+1 MVP) |
| If you roll . . . 1, 3 or 5 Date | (−2 MVP) |
| Compatible | |
| Although you are strongly attracted to the person you're dating, you know you would never marry them. | |
| (Use 1 MVP to avoid this situation, or roll the die) | |
| If you roll . . . 2, 4 or 6 Dump | (+1 MVP) |
| If you roll . . . 1, 3 or 5 Date | (−2 MVP) |
| Peer Pressure | |
| The one you've been dating for some time says they will leave you unless you "go all the way" with him/her. | |
| (Use 1 MVP to avoid this situation, or roll the die) | |
| If you roll . . . 2, 4 or 6 Dump | (+1 MVP) |
| If you roll . . . 1, 3 or 5 Date | (−2 MVP) |
| Respect | |
| Against your wishes, your date keeps seductively talking and looking at you. | |
| (Use 1 MVP to avoid this situation, or roll the die) | |
| If you roll . . . 2, 4 or 6 Dump | (+1 MVP) |
| If you roll . . . 1, 3 or 5 Date | (−2 MVP) |
| Compatible | |
| You "love" the person you've been dating, but you just can't get along. | |
| (Use 1 MVP to avoid this situation, or roll the die) | |
| If you roll . . . 2, 4 or 6 Dump | (+1 MVP) |
| If you roll . . . 1, 3 or 5 Date | (−2 MVP) |
| Self Control | |
| Your date asks you to leave the group you came with to go spend time alone. | |
| (Use 1 MVP to avoid this situation, or roll the die) | |
| If you roll . . . 2, 4 or 6 Dump | (+1 MVP) |
| If you roll . . . 1, 3 or 5 Date | (−2 MVP) |
| Peer Pressure | |
| You're not quite ready, but all your friends seem to be having sex with their dates. | |
| (Use 1 MVP to avoid this situation, or roll the die) | |
| If you roll . . . 2, 4 or 6 Wait | (+1 MVP) |
| If you roll . . . 1, 3 or 5 Have Sex | (−2 MVP) |
| Compatible | |
| You are a strong spiritual person. You are dating someone whom you love and get along with but they have no spiritual interest. | |
| (Use 1 MVP to avoid this situation, or roll the die) | |
| If you roll . . . 2, 4 or 6 Dump | (+1 MVP) |
| If you roll . . . 1, 3 or 5 Date | (−2 MVP) |
| Abuse | |
| Your date curses you out and slaps you for looking at the | |

TABLE 2-continued

| | |
|---|---|
| opposite sex. They immediately apologize and ask for forgiveness. | |
| (Use 1 MVP to avoid this situation, or roll the die) | |
| If you roll . . . 2, 4 or 6 Dump | (+1 MVP) |
| If you roll . . . 1, 3 or 5 Date | (−2 MVP) |
| Self Control | |
| You like a person that's committed to someone else. | |
| They ask you for a date. | |
| (Use 1 MVP to avoid this situation, or roll the die) | |
| If you roll . . . 2, 4 or 6 Say Yes | (+1 MVP) |
| If you roll . . . 1, 3 or 5 Say No | (−2 MVP) |
| Self Control | |
| You are kissing and things are heading further than you planned. | |
| (Use 1 MVP to avoid this situation, or roll the die) | |
| If you roll . . . 2, 4 or 6 Stop | (+1 MVP) |
| If you roll . . . 1, 3 or 5 Continue | (−2 MVP) |
| Honesty | |
| You were honest during the date. | |
| (Use 1 MVP to avoid this situation, or roll the die) | |
| If you roll . . . 2, 4 or 6 Dump | (+1 MVP) |
| If you roll . . . 1, 3 or 5 Date | |

The game board is typically fashioned from a stiff material, such as cardboard or thin plastic. Preferably, the game board is also foldable for easy storage.

A plan view of the playing surface 30 of a game board 31 for use in accordance with the inventive method is shown in FIG. 3. As can be seen, displayed on the playing surface of the board is at least one track 32. Each track is formed of spaces corresponding to one of the designated categories of cards, i.e., spaces 34 for the character cards and spaces 36 for the challenge cards. A player landing on a space corresponding to the character cards may be entitled to draw a character card, while a player landing on a space corresponding to the challenge cards, may have to draw a challenge card.

To provide variety to and increase interest in the game, certain of the character spaces, designated "all player" character spaces (not shown), can provide that all the players, not just the player landing on the character space, are entitled to draw a character card. Similarly, certain of the challenge spaces, designated "all player" challenge spaces (not shown), can provide that all players, not just the player landing on the challenge space, may have to draw a challenge card.

The number of spaces corresponding to the respective categories is in a predetermined proportion to provide desired probabilities of events. The greater the number of spaces corresponding to character traits 34 vis a vis the number of spaces corresponding to challenges 36, the less risky the dating experience.

Figure 4:
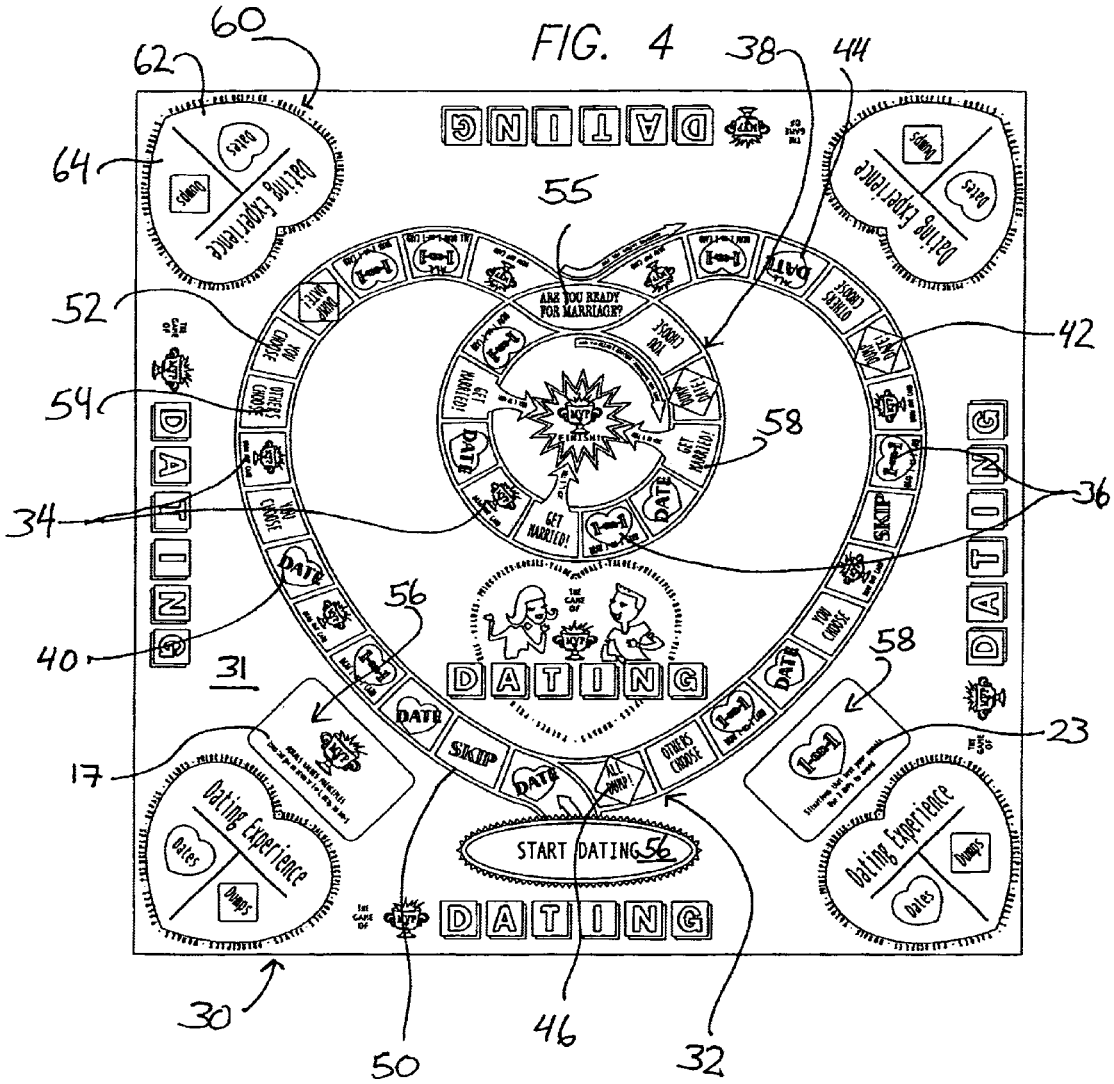
FIG. 4 is a plan view of a playing surface for use in accordance with the present invention.

The embodiment shown in FIG. 4 contains a second track 38, where the relative proportion of character spaces to challenge spaces in the first track 32 is greater than the relative proportion of in the second track 38. For example, the relative proportion of character spaces 34 to challenge spaces 36 in the first track is about 1:1, while the relative proportion of character spaces to challenge spaces in the second track is about 1:2. Thus, the first track corresponds to a relatively challenge-free date-for-fun track, while the second track corresponds to a more challenge-filled serious dating track.

To increase the complexity of certain embodiments, each player is given the opportunity, at various points throughout the game play, to choose whether or not to date. For so long as a player chooses not to date, he or she cannot be subject to the challenges of dating and does not have to draw a challenge card, if he or she lands on a challenge space.

In such embodiments, the game board tracks 32 and 38 can additionally contain "date" spaces 40. When a player lands on a date space, he or she can begin to date. A player who does not want to date at this stage of the game can be given several options. The player can redeem one, preferably two, or more character cards. Alternatively, if the player has a character card on which "waiting" is the represented character trait, the player can present the card and avoid dating while retaining the card.

The game board 30 corresponding to such embodiments can additionally include "dump" spaces 42, i.e., stop dating spaces. When a player lands on a dump space, a player who is currently dating can choose to stop. A player who does not want to stop date at this stage of the game can be given several options. The player can redeem one, preferably two, or more character cards. Alternatively, if the player can demonstrate that he or she has a character card which relates to "dumping," the player can present the card and avoid dating while retaining the card.

To provide variety to and increase interest in the game, certain of the date spaces, designated as "all player" date spaces 44, can provide that all the players, must begin or take an action to avoid dating. Similarly, certain of the dump spaces, designated as "all-player" dump spaces 46, can provide that all the players must stop dating or take an action to continue dating. As an aid to keeping the game competitive, in some embodiments, when a player who has obtained a certain maximum number of dates, e.g., three dates, lands on a date space or another player lands of an all player date space, the player does not get an additional date.

If desired, additional materials of chance can be interjected in the game by including "rest" spaces (not shown), "skip" spaces 50, "you choose" spaces 52 and/or "others choose" spaces 54 on at least one of the tracks. A player landing on a "rest" space loses that turn. A player landing on a "skip" space loses his or her next turn. A player landing on a "you choose" space is entitled to choose whether he or she wants to begin a date, end a date, pick a character card or pick a challenge card. If a player lands on an "others choose" space, another player, such as the player on the left, is entitled to choose whether the player who landed on the space must begin a date, end a date, pick a character card or pick a challenge card.

Preferred embodiments also have a starting space 56 on the date-for-fun track 32, one or more "get married" spaces 58 on the serious dating track 38, and a transitional space 55 shared by both tracks.

The game board 30 suitably includes portions designated to receive the character and challenge cards, 56 and 58 respectively. The game board also suitably includes areas 60 for each player with portions 62 and 64 designated to indicate the players dating experience status, i.e., the number of dating and/or dumping experiences, respectively.

Other materials preferably included with the game include player markers, for indicating a player's position on the track(s), dating experiences markers for keeping track of a players dates and or dumps (collectively a player's dating experiences), and a pseudo-random number generator, such as a die or spinner, for determining a player's movement along the track(s). The preferred embodiment of the game accommodates 2 to 4 players or teams of players.

Typically, the order of play is determined by chance. For example, each player rolls the die to determine a first player. Play starts with that player, who begins by placing his or her player marker on the starting space and again rolling the die to determine how many spaces down the track his or her marker should be moved. Then, each successive player to the left plays in turn. In some embodiments, to expedite play, each player is initially given two character cards.

A player, at his or her own option, may decide whether to start the game dating or not dating. If a player chooses to begin by dating, he or she places a dating experience marker in the appropriate area on the playing surface. Subsequently, at the beginning of each turn, upon redeeming one, preferably two, or more character cards a player may choose to begin or to stop dating. Each time a player begins a new dating experience, an additional marker is placed on the appropriate portion of the playing surface. And if a player forfeits a dating experience, one of the player's markers is removed from the board.

Each player in turns moves his or her marker in accordance with the results of rolling the die. When a player lands on a character or a challenge space, he or she selects a card from the associated one of the decks. If a player does not have the character cards required to meet a challenge, the player looses one dating experience and his or her marker is moved back to the starting space.

To cause a player to focus on the issues raised by the game play, so as to enhance a player's learning experience, a player who chooses to redeem a character card and avoid a challenge may be asked to explain how the character trait represented on the character card could be used to overcome the challenge in a real dating situation. Alternatively, a player landing on a challenge space may be permitted to draw a character cared and then explain how the character trait represented on the drawn card could be used to overcome the challenge. A thoughtful response can be rewarded by allowing the player to avoid the situation and keep the character card. To facilitate the flow of the game, it may be decided not to permit the option of providing such explanations, when a player lands on an all player challenge space.

In some embodiments, a player must obtain a certain number of dating experiences and/or character cards, before the player can move from the dating-for-fun track to the serious dating track. For example, a player might be required to have at least five character cards and at least three dating experiences. Once a player has met these requirements and if the player lands of the transition space, then the player can move his or her marker to the serious dating track. To stay on the serious dating track, the play must maintain at least five character cards.

A player landing on a "get married" space is given the opportunity to get married and win the game. However, before a player can get married and win the game, the player must have at least one dating marker. In some embodiments, there can be additional requirements, such as a player having to roll a six within three tries, before a player is married.

While in one embodiment, the game is implemented as a board game, the game is readily adaptable to a computer environment, and may be provide on a floppy disk, CD ROM or other suitable electrical medium. Further, in an electronic embodiment, the game can be played by players at diverse locations, via a local area network, wide area network or an extended network such as the Internet. Accordingly, the various terms employed in the above description to identify physical components, such as game board and track, marker, dice, cards, etc. should be taken to include electronic media equivalents. The foregoing is a description of preferred exemplary embodiments. The invention is not limited to the specific forms shown. For example, modifications may be made in the design and arrangement of the elements within the scope of the invention, as expressed in the appended claims.

I claim:

1. A game for multiple players comprising a first deck containing a plurality of MVP cards, the MVP cards in the first deck having a face containing information representing a character trait;

a second deck containing a plurality of 1-on-1 card, the 1-on-1 cards in the second deck having a face containing information representing a dating challenge and information representing at least one resolution to the dating challenge;

a playing surface displaying it least one track, containing spaces corresponding to the first deck of MVP cards and the second deck of 1-on-1 cards;

a marker for marking each player's position on the playing surface on the at least one track, a plurality of tokens associated with each player for use in counting the player's game choices; and a number generator for determining how many spaces each player's wherein winning the game is determined by a combination of a accumulation of a predetermined number of MVP cards representing good dating choices, a predetermined accumulation and distribution of tokens among the player's game choices representing a predetermined minimum of dating experience, and maker position on the playing surface representing in part random chance.

2. The game in accordance with claim 1 wherein the first deck further comprises MVP cards having a face containing information indicating that the MVP card is a bonus MVP card entitling the player to draw additional MVP cards.

3. The game in accordance with claim 1 wherein the face containing information on at least one of the 1-on-1 cards of the second deck contains information representing a plurality of alternative resolutions to the dating challenge.

4. The game in accordance with claim 1 wherein the playing surface displays two tracks, a date-for-fun track and a serious dating track, and the relative proportion of spaces corresponding to the first deck of MVP cards to second deck of 1-on-1 cards in the first date-for-fun track is greater than the relative proportion of spaces corresponding to the first deck of MVP cards to second deck of 1-on-1 cards in the second serious dating track.

5. The game in accordance with claim 4 wherein the relative proportion of spaces corresponding to the first deck of MVP cards to second deck of 1-on-1 cards in the first date-for-fun track is about 1:1 and the relative proportion of spaces corresponding to the first deck of MVP cards to second deck of 1-on-1 cards in the second serious dating track is about 1:2.

6. The game in accordance with claim 5 wherein at least one of the two tracks further comprises a DATE space with a designation that a player landing on the DATE space must take an action to date or not to date.

7. The game in accordance with claim 1 where the playing surface has a DATE position in a DATING EXPERIENCE section of the playing surface, where one of the MVP cards is a "waiting" MVP card, and wherein at least one of the two tracks further comprises a DATE space with a designation that, if a player landing on the DATE space has accumulated one or more tokens, then the player must choose between taking an action to go on a date by moving a token to the DATE position on the DATING EXPERIENCE section of the playing surface corresponding to the player to indicate that the player goes on a date, or does not go on a date either by playing the "waiting" MVP cards if the players has such an MVP card or by discarding one or more MVP cards.

8. The game in accordance with claim 1 wherein at least one of the two tracks further comprises an OTHERS CHOOSE space with a designation that a player other than a player landing on the OTHERS CHOOSE space must choose whether the player landing on the OTHERS CHOOSE space must move his or her token to indicate that the player begins a date, dumps a date, draw a card from the first deck of MVP cards or draw a card from the second deck of 1-on-1 cards.

9. The game in accordance with claim 4 wherein the first date-for-fun track and second serious dating tracks have a space on the playing surface in common.

10. The game in accordance with claim 1 where the number generator comprises a pseudo-random number generator and a game board bearing the playing surface.

11. The game of claim 1 where the plurality of tokens associated with each player for use in counting the player's game choices comprise tokens associated with each player's game choices to date or not date.

12. The game of claim 11 where the tokens associated with each players game choices to date or not date further comprise plurality of tokens associated with each player choices to dump a date.

13. The game of claim 12 further comprising a DATES position and a DUMPS position in a DATING EXPERIENCE section of the playing surface corresponding to each player and where the tokens associated with each player's choices to date or to dump a date are indicated by placement a token corresponding to the token being placed in the DATES position or DUMPS position of the DATING EXPERIENCE section corresponding to the player so that players game choices are recorded for determination of eligibility to win the game.

14. The game of claim 12 where at least one space of one of the two tracks is a DUMP DATE! space designated such that the player landing on the DUMP DATE! space must move one of his or her corresponding tokens from the DATES position to the DUMPS position of the DATING EXPERIENCE section of the player.

15. The game of claim 12 where at least one space of one of the two tracks is a ALL DUMP! space designated such that when any player lands on the ALL DUMP! space, each players must move one of his or her corresponding tokens from the DATES position to the DUMPS position of the DATING EXPERIENCE section of each player.

16. The game of claim 1 where the second deck containing the plurality of 1-on-1 cards having a face containing information representing at least a first resolution to the dating challenge available for player choice end at least a second and third resolution to the dating challenge available according random selection, the selection of the first resolution or a randomly selected one of the second and third resolutions in turn being selected by player choice.

17. A game for a plurality of players comprising:

a first MVP deck containing a plurality of cards, each card in the first MVP deck having a face containing information representing a character trait;

a second 1-ON-1 deck containing a plurality of cards, each card in the second 1-ON-1 deck having a face containing information representing a dating challenge and information representing a plurality of alternative resolutions to the dating challenge; and a playing surface displaying two tracks, each track containing a plurality of spaces corresponding to the first deck of MVP cards and the second deck of 1-ON-1 cards, the relative proportion of spaces corresponding to the first deck of MVP cards to second deck of 1-ON-1 cards in the first one of the two tracks being greater than the relative proportion of spaces corresponding to the first deck of MVP cards to second deck of 1-ON-1 cards in the second one of the two tracks and the two tracks having a space in common;

a marker for marking each player's position on the playing surface on the at least one track, a plurality of tokens associated with each player for use in counting the player's date or dump choices; and a number generator for determining how many spaces each player's marker moves on the playing surface, wherein winning the game is determined by a combination of a accumulation of a predetermined number of MVP cards representing good dating choices, a predetermined accumulation and distribution of tokens among the date and dump choices representing a predetermined minimum of dating experience, and make position on the playing surface representing in part random chance.

18. The game in accordance with claim 17 wherein the relative proportion of spaces corresponding to the first deck of MVP cards to second deck of 1-ON-1 cards in the first track is about 1:1 and the relative proportion of spaces corresponding to the first deck of MVP cards to second deck of 1-ON-1 cards in the second track is about 1:2.

19. The game in accordance with claim 17 wherein at least one track further comprises a DATE space with a designation that a player landing on the space must choose to date or not date draw a card from the first deck of MVP cards or draw a card from the second deck of 1-ON-1 cards, and a OTHERS CHOOSE space with a designation that a player other than a player landing on the space must choose whether the player landing on the OTHERS CHOOSE space must choose to date or to dump a date, draw a card from the first deck of MVP cards or draw a card from the second deck of 1-ON-1 cards.

20. The game in accordance with claim 17 where the number generator comprises a pseudo-random number generator, and a game board bearing the playing surface.

* * * * *